United States Patent [19]

Caldwell et al.

[11] 4,441,650

[45] Apr. 10, 1984

[54] LAMP PACKAGE

[75] Inventors: David H. Caldwell, Marblehead; Robert M. Hurley, Lexington, both of Mass.

[73] Assignee: GTE Products Corporation, Stamford, Conn.

[21] Appl. No.: 412,754

[22] Filed: Aug. 30, 1982

[51] Int. Cl.[3] ..... B65D 85/42

[52] U.S. Cl. ..... 229/39 B; 206/422

[58] Field of Search ..... 229/39 B, 40; 206/419, 206/422, 429, 434, 45.14

[56] References Cited

U.S. PATENT DOCUMENTS

| | | | |
|---|---|---|---|
| D. 210,323 | 2/1968 | Hurley | D9/224 |
| 2,832,182 | 4/1958 | McGihon | 206/434 X |
| 2,883,047 | 4/1959 | Candell | 206/65 |
| 2,892,581 | 6/1959 | Amatel | 229/90 |
| 2,983,372 | 5/1961 | Amatel et al. | 206/419 |
| 3,051,369 | 8/1962 | Drake et al. | 229/39 B |
| 3,064,457 | 11/1962 | Vanden Boom et al. | 206/419 |
| 3,069,008 | 12/1962 | Dugre | 206/65 |
| 3,116,004 | 12/1963 | Tyrseck et al. | 229/39 B |
| 3,167,214 | 1/1965 | Mahon | 229/40 X |
| 3,822,785 | 7/1974 | Getz et al. | 206/422 |
| 4,007,836 | 2/1977 | Getz et al. | 206/422 |
| 4,058,211 | 11/1977 | Barbiere et al. | 206/422 |
| 4,215,779 | 8/1980 | Vajtay | 206/421 |

FOREIGN PATENT DOCUMENTS

| | | | |
|---|---|---|---|
| 1380240 | 1/1975 | United Kingdom | 206/434 |

*Primary Examiner*—William Price
*Assistant Examiner*—Gary E. Elkins
*Attorney, Agent, or Firm*—Lawrence R. Fraley

[57] ABSTRACT

A paperboard container for a pair of electric incandescent lamps which is in the form of a parellelepiped and includes as part thereof or secured thereto first and second pairs of lamp-engaging tab members which extend inwardly of the parrellelepiped to positively engage a respective one of the electric lamps at spaced locations thereon and cause the lamps to be in physical contact when positioned within the container. The container is formed from a single sheet of material through a series of folding and bending operations to thus provide an inexpensive and compact finished product.

18 Claims, 7 Drawing Figures

LAMP PACKAGE

DESCRIPTION

1. Technical Field

This invention relates to packaging for electric lamps and particularly to such packaging for lamps having bulbous-shaped glass envelopes. Even more particularly, the invention relates to such packaging wherein the number of such lamps to be contained therein is equal to or exceeds two.

2. Background

Several types of packages for delicate, fragile articles such as electric lamps of the incandescent variety are known in the art. Examples are illustrated in U.S. Pat. Nos. 2,892,581 (Amatel), 3,051,369 (R. W. Drake et al), and 3,069,008, (Dugre). Such packages may consist of a separate, corrugated paperboard carton having opposed open ends through which a single bulbous-shaped lamp is inserted. Each carton is then usually encased in a separate paperboard sleeve or similar element which covers the carton's open ends. Typically, only two cartons (and therefore two incandescent lamps) are contained in a single package. In another embodiment, the dual lamp package may consist of a folded sheet which defines two lamp-receiving chambers (or compartments) therein separated by a partition or similar member which in turn prevents the delicate glass lamps from physically contacting each other while contained therein.

Each two-lamp package is usually prepared for shipping by placing it within a larger cardboard box with several other packages. To facilitate the handling of the sealed boxes in the warehouse and during loading and unloading, a number of these are usually placed on a pallet and the pallets then stacked one upon the other. As a result of such stacking, the individual lamp wrappers of the lamp packages within the shipping boxes are subjected to compressive stresses which frequently cause the wrapper walls to buckle and collapse, with the result often being that the glass bulbs are sometimes crushed and broken. Breakage is also possible during normal handling of the individual package (e.g., by dropping) by the package consumer.

It was heretofore thought, as evidenced by the package examples illustrated in the aforementioned patents, that to prevent breakage of the fragile glass lamps it was necessary to provide the above partitions or similar members to effectively separate the contained lamps as well as provide cushioning means therefore (e.g., by providing the partition with corrugation or with resilent, bendable tabs). In addition, various alternative cushioning and impact means were similarly employed and often deemed essential.

DISCLOSURE OF THE INVENTION

It is, therefore, a primary object of this invention to provide a new and unique package means for at least two bulbous-shaped lamp articles wherein the lamps are located therein in physical contact with each other and yet which assures that breakage of the lamps is substantially prevented during the aforedescribed and similar conditions (e.g., wherein the package is exposed to shock, vibration, compression, handling, etc).

It is another object of the invention to provide such a package wherein the container of the package as finally assembled is of one-piece, folded construction, thus eliminating the need for such added items as individual cartons, separating partitions, etc.

It is yet another object of the invention to provide a lamp package means which can be readily assembled on a high production basis, and is therefore inexpensive to produce.

In accordance with one aspect of the invention problem there is provided a container for a pair of electric lamps wherein the container comprises a parallelepiped of paperboard material for having the lamps positioned therein, and first and second pairs of lamp-engaging tab members which are secured to or form part of the parallelepiped and extend substantially inwardly thereof. Each of these pairs of tab members is adapted for engaging in a positive manner a respective one of the electric lamps at spaced locations thereon to cause the pair of electric lamps within the parallelepiped to be in physical contact with each other.

In accordance with another aspect of the invention, there is provided a lamp package which comprises a container in the form of a parallelepiped of paperboard material, a pair of electric lamps located within the parallelepiped in physical contact with each other and first and second pairs of lamp-engaging tab members secured to or forming part of the parallelepiped container and extending substantially inwardly thereof. Each of these pairs of tab members positively engage a respective one of the electric lamps at spaced locations thereon to cause the lamps to be in the stated physical contact with each other.

BEST MODE FOR CARRYING OUT THE INVENTION

For a better understanding of the present invention together with other and further objects, advantages, and capabilities thereof, reference is made to the following disclosure and appended claims in connection with the above-described drawings.

Figure 1:
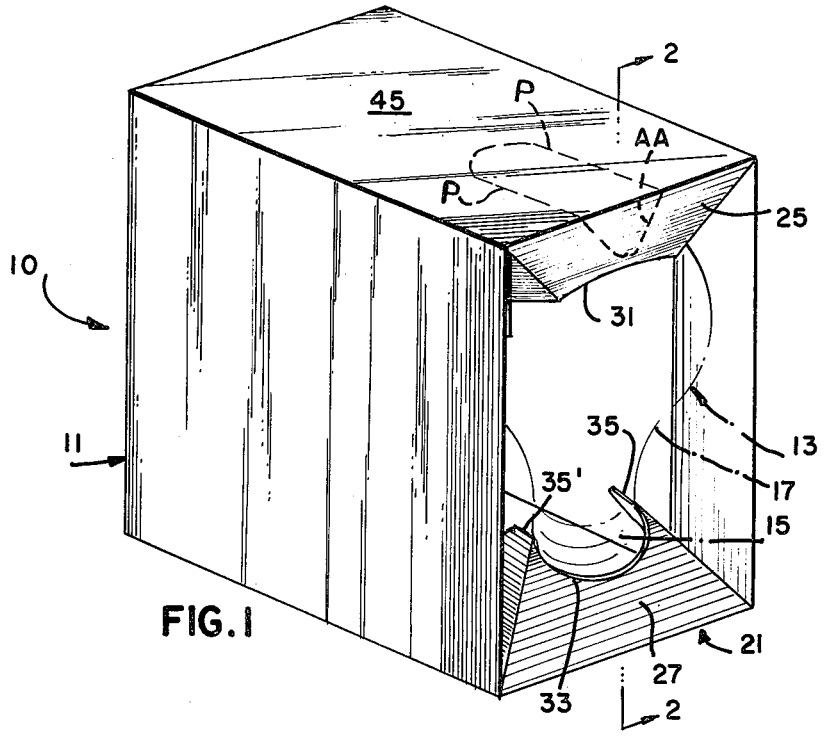
FIG. 1 is a perspective view of a lamp package in accordance with one embodiment of the invention.

With particular attention to FIG. 1, there is shown a lamp package 10 which comprises a container 11 of parallelepiped configuration and having therein a pair of electric incandescent lamps 13 (only one shown in phantom in FIG. 1). Lamps 13 are of the incandescent variety and typically consist of a metalic screw-on base 15 and a bulbous glass envelope 17 which extends from the base and contains the lamp's filament structure, gaseous atmosphere, etc. Lamps of this type are typically of the 40, 60, 75, 100, and 150 watt category although it is of course understood that other lamps may also be positively contained by container 11 and thus form part of the subject invention.

Container 11 is of paperboard material with suitable examples being solid bleached sulfate, chip board, and bleached manila. As will be described below, container 11 is formed from a singular sheet of this paperboard material through a series of folding and bending operations. To facilitate this procedure, as well as provide a substantial reduction in overall cost for the finished product, container 11 is of a single ply construction and thus does not include corrugations or similar convoluted features as part thereof. Thicknesses for container 11 within the range of from about 0.014 inch to about 0.022 inch proved ideal for the finished product.

As stated, container 11 is in the form of a parallelepiped. Specifically, a container includes a total of six sides, opposing pairs of which are in the form of a parallelogram. In the embodiment depicted in FIG. 1, each of the sides is a rectangle. Furthermore, four of these side panels are solid while two are shown as being substantially open.

Figure 2:
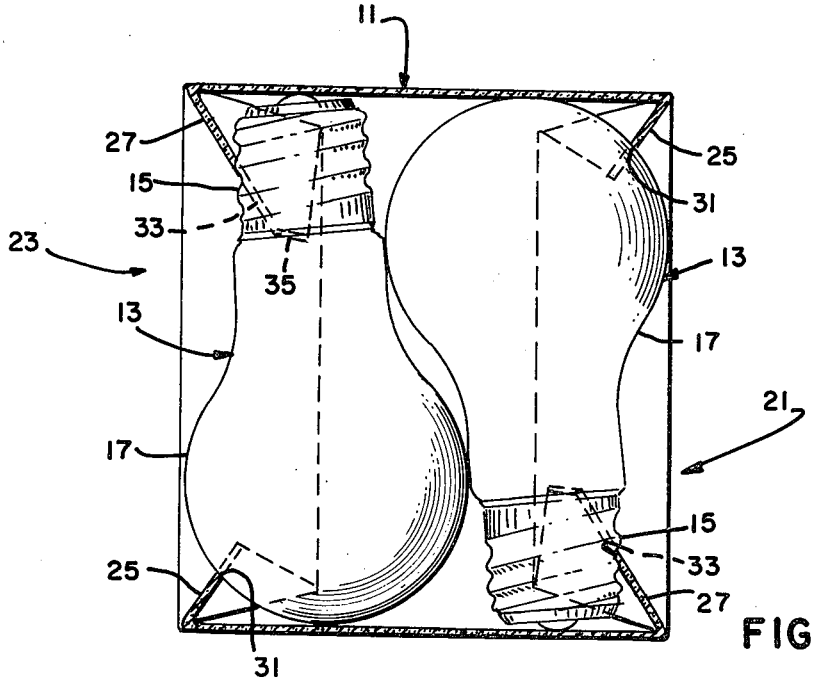
FIG. 2 is an elevational view, in section, of the lamp package of FIG. 1 as taken along the line 2—2 in FIG. 1.

As clearly shown in FIG. 2, each of the glass envelopes 17 of lamps 13 are in physcial contact with each other within container 11. In addition, the lamps are positioned in substantially opposing directions. It can be seen in FIG. 2 that in this arrangement, the respective metal bases 15 engage the internal surface of one of the sides of container 11 while the respective envelope in turn engages an internal surface of an opposite side thereof. As stated above, one of the truly unique features of the instant invention is that container 11 is able to positively contain the two fragile glass lamps 13 therein such that damage thereto is substantially prevented and yet wherein physical contact between the two is possible. One distinct advantage of such a close relationship for lamps 13 is that the overall size of the finished product is substantially reduced in comparison to previous lamp packages wherein the aforedescribed corrugated partitions between the envelopes was deemed essential. The result, therefore, is a finished product of compact design which provides positive retention of delicate glass articles and yet which substantially prevents breakage thereof at least equally as well as said known partition-type packages.

The above and other features are possible as a result of the provision of first and second pairs 21 and 23 of lamp-engaging tab members which are secured to or form part of the parallelepiped container and extend inwardly thereof (FIG. 2). Each pair is substantially identical in configuration and includes a first tab member (represented by the numeral 25) and a second tab member (represented by the numeral 27). Each of these first tabs 25 includes a curved edge 31 which is designed for engaging the corresponding curved surface of the respective glass envelope 17. Each of the second tab members 27 of each pair also includes a curved edge (33) which is designed for engaging the corresponding metalic base 15 of each respective lamp 13. It has thus been shown that each pair of tab members 25 and 27 is designed for positively engaging the respective lamp 13 at spaced locations thereon. Because the tabs project inwardly of container 11, they thus work in a cooperative fashion to maintain the two lamps in physical contact within the container as shown in FIG. 2. This contact is clearly illustrated as being at two spaced locations along each of the glass envelopes.

Figure 7:
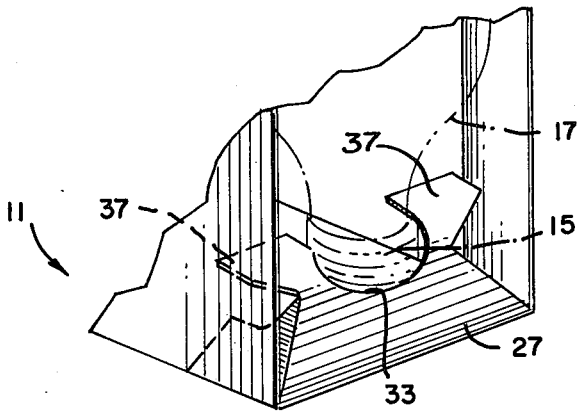
FIG. 7 is a partial perspective view of a lamp package in accordance with an alternate embodiment of the invention.

In view of the relatively smaller diameter of the cylindrical base 15 of each lamp, the curvature of surface 33 of tab 27 is substantially less than the greater curvature for edge 31 of the envelope engaging opposing tab 25 of each pair. In addition, it is preferred, though not necessary, that each of the base-engaging tabs 27 include an opposed pair of linear segments 35, 35' (FIG. 1) which extend from the curved edge 33 and are designed for engaging opposite sides of base 15 in the manner shown. Such engagement assists in preventing possible lateral movement of base 15 within container 11. It is to be understood, however, that these linear segments are not essential in the subject invention in that curved surface 33 could simply be extended upwardly and around base 15 to contact the base at said locations. Such an arrangement is depicted in FIG. 7 wherein there is also shown the use of projections 37 which project from the tab member 27. Specifically, each of these projections project from tab 27 in opposite directions to engage a respective internal surface of one of the opposing larger sides of parallelepiped container 11. As such, assistance in the substantial prevention of possible lateral movement of base 15 within the container (e.g., during shipping) is assured.

Figure 3:
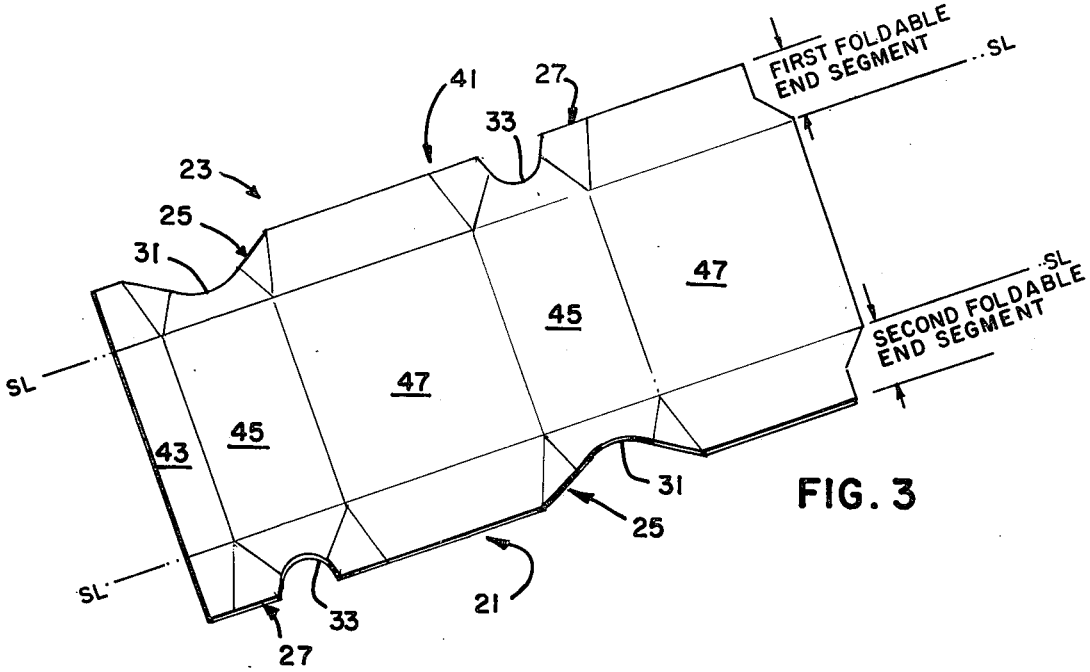
FIG. 3 is a perspective view of a paperboard blank from which the subject invention is formed.

In FIG. 3, there is shown a blank 41 in the form of a single sheet of material which is to eventually form the finished container 11 as described above. Blank 41 has been printed (not shown) with the necessary identifying markings, logos, etc. and, as shown, has been cut and scored in the desired pattern. Specifically, several scorelines have been provided in the planar blank 41 in the pattern shown in FIG. 3 to define in turn a connecting flap 43, a pair of opposed narrow side panels 45, and a pair of opposed wide side panels 47. In addition, blank 41 has been scored in its longitudinal direction to define a pair of opposing, first and second foldable end segments. Each segment, which runs the full length of the blank, includes a respective one of the aforementioned pairs of lamp-engaging tab members. Specifically, the first foldable end segment includes as part thereof the second pair 23 of foldable tab members 27 and 25 whereas the second foldable end segment includes the corresponding tab members of the first pair 21 of these members. The curved edge members of each tab are also clearly shown in FIG. 3. Understandably, the configuration of blank 11 is defined by the cutter which forms part of the assembly apparatus for producing the instant invention.

Figure 4:
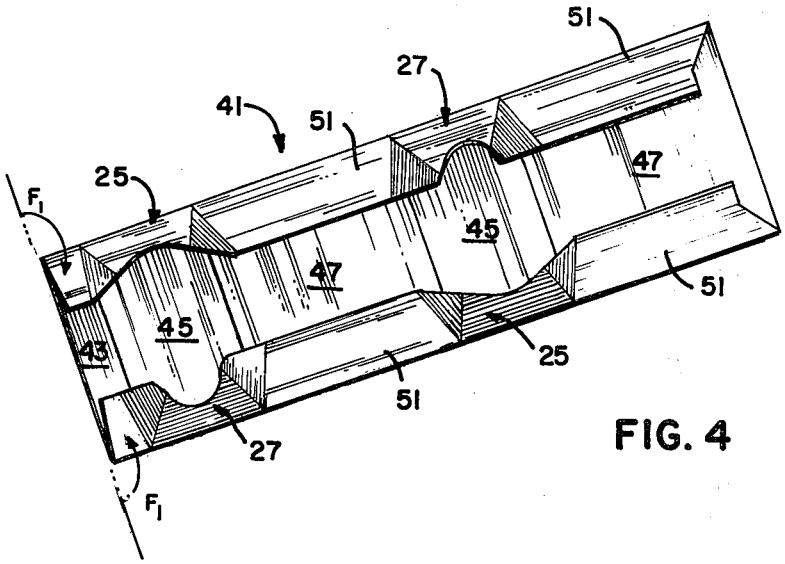
FIGS. 4–6 represent the various steps in folding and bending the paperboard blank in FIG. 3 to produce the lamp package in accordance with one embodiment of the invention.
Figure 5:
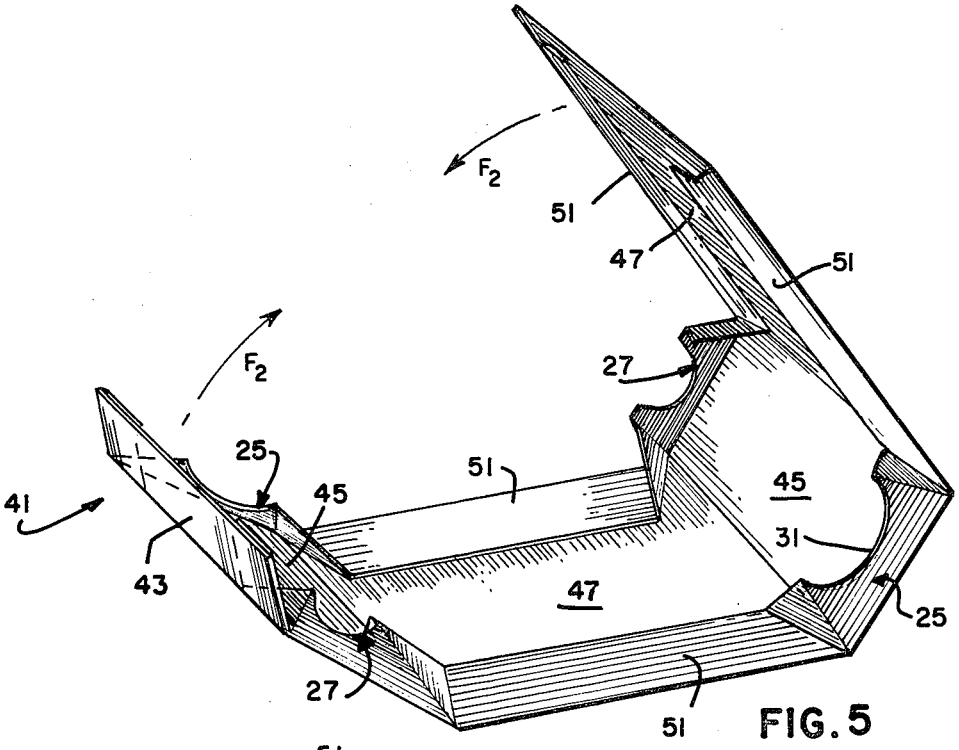
Figure 6:
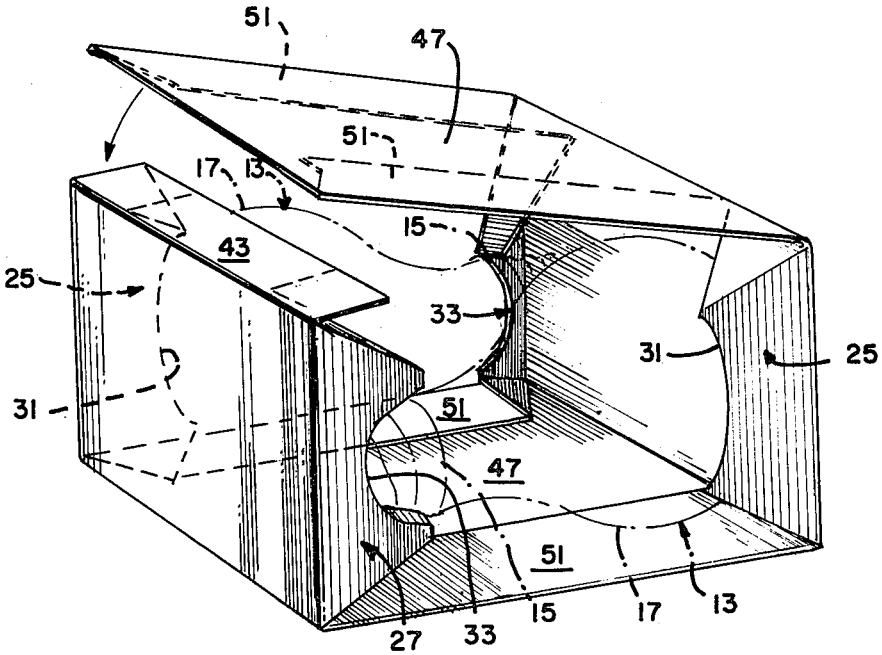

In FIGS. 4–6, there are shown the various bending and folding steps employed to form the finished container 11 having the described pair of incandescent lamps 13 securedly retained therein. In FIG. 4, each of the opposing foldable end segments is folded along one of the respective score lines SL—SL as indicated by the arrows $F_1$ in FIG. 4. It is understood that at this point each end segment is substantially flush with the remaining, planar portions (43, 45, 47) of blank 41. In the next step of this operation, each of the respective tab members 25 and 27 is slightly raised from this flush position to facilitate positioning of the incandescent lamps and also assure positive contact therewith. Once this is completed, blank 41 is bent along the four lateral score lines which define the aforementioned side panels and connecting tab, said bending represented by the arrows $F_2$ in FIG. 5. It can be seen in FIG. 5 that the longitudinal sections (51) which constitute the portions of the described foldable end segments not occupied by tab members 25 or 27 lie flush against a respective side panel (47). This flush relationship is also shown in FIG. 6. Preferably, each of the segments 51 is now glued in this position. Immediately prior to final closure of container 11, the pair of opposingly positioned incandescent lamps 13 is inserted and engaged by the respective tab members 25 and 27. Subsequently, closure is effected by glueing the uppermost wide side panel 47 to connecting tab 43. A glue suitable for the above operation can be obtained from any of those presently used in the industry and further description is thus not deemed necessary.

The subject invention, in addition to providing the several unique and advantageous features described above, also provides a means whereby ready access to the enclosed contents of the package is possible. Specifically, the package user need only depress a defined access area AA (shown in FIG. 1) in an inward manner and tear back along perforations P enabling the package user to readily grasp the glass envelope 17 of the now exposed lamp 13 and effect its removal. Removal of the remaining, inverted lamp 13 is possible in a similar fashion from the opposing, open side of container 11. It can be seen in the sectional view of FIG. 2 that the invention is uniquely designed so as to subsequently prevent accidental removal of the remaining incandescent lamp once the first lamp has been removed by the packaged user. Specifically, the remaining lamp is substantially prevented from removal through the same opening as the initially removed lamp by the contour of edge 33 which provides a friction hold on the lamp base. By then applying slight pressure against the lower portion (base), the user is able to easily disengage the remaining lamp from this retainer and effect its removal through the same open end of the container through which the first lamp was removed.

There has thus been shown and described an improved lamp package which not only provides for positive containment of a pair of opposingly positioned delicate electric lamps but which does so in such a manner that the lamps are retained in physical contact with each other to substantially prevent breakage thereof during normal handling of the completed package. Because the container is of a single sheet of paperboard material subjected to relatively few bending and folding operations, the invention is readily adaptable to mass production and is thus extremely inexpensive to produce. In addition, the machinery necessary to provide the aforementioned bending and folding, in addition to cutting of the blank from which the container is formed, is also relatively inexpensive. In addition, the invention as defined above substantially eliminates the need for additional packaging components such as corrugated partitions and the like which not only add to the cost of the finished package but also on many occasions served to substantially increase the overall size thereof. Still further, the container as described above provides for a double thickness of material at many locations thereon (e.g., along the outer end portions of each of the defined wide side panels) to provide added reinforcement to the finished product, in addition to assuring greater cushioning from external impact forces.

While there have been shown and described what are at present considered the preferred embodiments of the invention, it will be obvious to those skilled in the art that various changes and modifications may be made therein without departing from the scope of the invention as defined by the appended claims.

What is claimed is:

1. A container for a pair of electric lamps wherein each of said lamps includes a bulbous glass envelope, said container comprising:

a parallelepiped of paperboard material for having said lamps positioned therein; and first and second pairs of lamp-engaging tab members secured to or forming part of said parallelepiped and extending substantially inwardly thereof, each of said pairs of said tab members adapted for acting in a cooperative manner with the other of said pair to positively engage a respective one of said electric lamps at spaced locations thereon to cause said glass envelopes of said electric lamps to be in physical contact with each other within said parallelepiped.

2. The container according to claim 1 wherein each of said electric lamps further includes a base, said bulbous glass envelope extending from said base.

3. The container according to claim 2 wherein said glass envelopes of said electric lamps are in physical contact at least at two locations thereon.

4. The container according to claim 2 wherein each of said tab members includes a curved edge member, the curved edge member of a first of said tab members in each of said pairs of tab members adapted for engaging said bulbous glass envelope of said respective electric lamp, the curved edge member of a second of said tab members in each of said pairs of tab members adapted for engaging said base of said respective electric lamp.

5. The container according to claim 4 wherein each of said second tab members in each of said pairs of tab members includes a pair of projection members projecting from each of said second tab members in substantially opposing directions and adapted for engaging the internal surfaces of opposing side panels of said parallelepiped.

6. The container according to claim 4 wherein the curvature of said curved edge member of each of said first of said tab members is greater than the curvature of said curved edge member of each of said second of said tab members.

7. The container according to claim 1 wherein said parallelepiped and said first and second pairs of lamp-engaging tab members are formed from a single sheet of said paperboard material.

8. The container according to claim 7 wherein said single sheet of said paperboard material is of single ply construction.

9. The container according to claim 1 wherein said paperboard material does not include corrugations as part thereof.

10. A lamp package comprising:

a container in the form of a parallelepiped, said parallelepiped container being of paperboard material;

a pair of electric lamps each including a bulbous glass envelope, said lamps positioned within said parallelepiped such that said glass envelopes are in physical contact with each other; and first and second pairs of lamp-engaging tab members secured to or forming part of said parallelepiped container and extending substantially inwardly thereof, each of said pairs of tab members acting in a cooperative manner with the other of said pair to positively engage a respective one of said electric lamps at spaced locations thereon and cause said glass envelopes of said lamps to be in said physical contact with each other.

11. The package according to claim 10 wherein each of said electric lamps further includes a base, said bulbous glass envelope extending from said base.

12. The package according to claim 11 wherein said bulbous glass envelopes of said electric lamps are in physical contact at least at two locations thereon.

13. The package according to claim 11 wherein each of said tab members includes a curved edge member, the curved edge member of a first of said tab members in each of said pairs of tab members adapted for engaging said bulbous glass envelope of said respective electric lamp, the curved edge member of a second of said tab members in each of said pairs of tab members adapted for engaging said base of said respective electric lamp.

14. The package according to claim 13 wherein each of said second tab members in each of said pairs of tab members includes a pair of projection members projecting from each of said second tab members in substantially opposing directions and adapted for engaging the internal surfaces of opposing side panels of said parallelepiped.

15. The package according to claim 13 wherein the curvature of said curved edge member of each of said first of said tab members is greater than the curvature of said curved edge member of each of said second of said tab members.

16. The package according to claim 10 wherein said parallelepiped and said first and second pairs of lamp-engaging tab members are formed from a single sheet of said paperboard material.

17. The package according to claim 16 wherein said single sheet of said paperboard material is of single ply construction.

18. The package according to claim 10 wherein said paperboard material does not include corrugations as part thereof.

* * * * *